US008749340B2

(12) United States Patent
Hsu et al.

(10) Patent No.: US 8,749,340 B2
(45) Date of Patent: Jun. 10, 2014

(54) ELECTRIC RECEPTACLE APPARATUS WITH REPLACEABLE PROTECTION MODULE

(75) Inventors: Jung-Hui Hsu, New Taipei (TW); Yu-Lung Lee, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 329 days.

(21) Appl. No.: 13/234,223

(22) Filed: Sep. 16, 2011

(65) Prior Publication Data

US 2012/0068807 A1 Mar. 22, 2012

(30) Foreign Application Priority Data

Sep. 17, 2010 (TW) ..... 99131721 A
Jan. 14, 2011 (TW) ..... 100101497 A

(51) Int. Cl.
*H01H 71/02* (2006.01)
*H01H 71/16* (2006.01)
*H01C 7/10* (2006.01)

(52) U.S. Cl.
USPC ..... 337/14; 307/15; 307/28; 307/31; 307/37; 307/66

(58) Field of Classification Search
USPC ..... 337/14, 15, 28, 31, 37, 66
See application file for complete search history.

(56) References Cited

U.S. PATENT DOCUMENTS

| | | | | | |
|---|---|---|---|---|---|
| 3,967,227 | A * | 6/1976 | Clarke et al. | ..... | 337/124 |
| 5,198,791 | A * | 3/1993 | Shibayama et al. | ..... | 337/31 |
| 5,200,875 | A * | 4/1993 | Yoshioka et al. | ..... | 361/56 |
| 5,311,164 | A * | 5/1994 | Ikeda et al. | ..... | 337/28 |
| 5,373,414 | A * | 12/1994 | Kondo | ..... | 361/129 |
| 5,438,309 | A * | 8/1995 | Krumme | ..... | 337/140 |
| 5,933,310 | A * | 8/1999 | Eggendorfer | ..... | 361/104 |
| 6,636,403 | B2 * | 10/2003 | McLoughlin et al. | ..... | 361/103 |
| 7,741,946 | B2 * | 6/2010 | Ho | ..... | 337/5 |
| 8,217,750 | B2 * | 7/2012 | Machida | ..... | 337/32 |
| 8,519,855 | B2 * | 8/2013 | Hsu | ..... | 340/584 |
| 2008/0129440 | A1 * | 6/2008 | Ho | ..... | 337/5 |
| 2012/0161973 | A1 * | 6/2012 | Hsu | ..... | 340/584 |

* cited by examiner

*Primary Examiner* — Anatoly Vortman
(74) *Attorney, Agent, or Firm* — Rosenberg, Klein & Lee

(57) ABSTRACT

A thermal protection module includes a surge absorber, a switch unit, and a pyrocondensation belt connected to the surge absorber and the switch unit. The switch includes a casing, at least one conductive pin, at least one conductive portion, and a moving part. The conductive portion is disposed on the moving part. The moving part is stuck in the casing movably. The conductive pins are stuck in the casing. The pyrocondensation belt is configured to shrink according to the heat conduction from the surge absorber, so as to change the position of the moving part. The conductive portion is in contact with or separated from the conductive pin according to the position of the moving part.

13 Claims, 6 Drawing Sheets

ELECTRIC RECEPTACLE APPARATUS WITH REPLACEABLE PROTECTION MODULE

BACKGROUND

1. Technical Field

The present disclosure relates to a protection module for protecting a load, especially to a thermal protection module.

2. Description of Related Art

To avoid the electronic components from being damaged by the transient voltage spikes of the power supply system, the conventional solution adds thermal cutoff fuses connected between the surge absorber and the power supply system. By melting the thermal cutoff fuse while absorbing too much heat, the electrical circuit and the power supply system are disconnected. However, the temperature of the surge absorber may be actually higher than that of the thermal cutoff fuse. Besides, the lifetime of the surge absorber is finite. Accordingly, it may have risky possibility of damages of surrounding electronic components while the surge absorber is on fire and the thermal cutoff fuse then melts, or while the surge absorber is on fire and the thermal cutoff fuse melts at the same time.

SUMMARY

An exemplary embodiment according to the present disclosure describes a thermal protection module including a surge absorber, a switch unit, and a pyrocondensation belt. The switch unit includes a casing, a first conductive pin, a moving part, and a first conductive portion. The moving part is stuck in the casing movably. The first conductive pin is stuck in the casing. The first conductive portion is disposed on the moving part, and the first conductive portion is in contact with or separated from the first conductive pin. The pyrocondensation belt is connected to the surge absorber and the moving part.

For further understanding of the present disclosure, reference is made to the following detailed description illustrating the exemplary embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DETAILED DESCRIPTION OF THE EXEMPLARY EMBODIMENTS

Figure 1A:
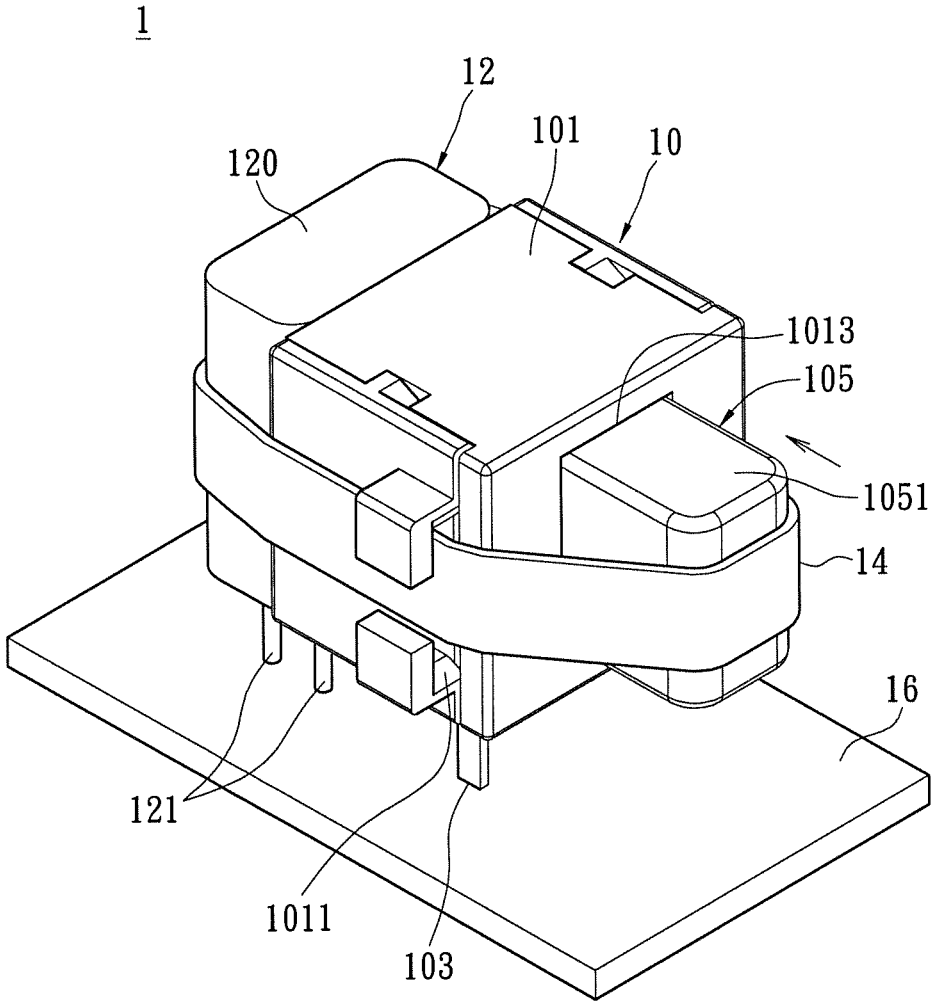
FIG. 1A is a schematic diagram of a thermal protection module according to an exemplary embodiment of the present disclosure.

Refer to FIG. 1A. FIG. 1A illustrated a schematic diagram of a thermal protection module according to an exemplary embodiment of the present disclosure. As shown in FIG. 1A, the thermal protection module 1 comprises a switch unit 10, a surge absorber 12, and a pyrocondensation belt 14. The surge absorber 12 and the pyrocondensation belt 14 are disposed on a circuit board 16, and electrically connected to each other. The pyrocondensation belt 14 is connected with the switch unit 10 and the surge absorber 12.

The switch unit 10 comprises a casing 101, a plurality of conductive pins 103, and a moving part 105. The switch unit 10 may further include a guide rail 1011 and an opening 1013. The moving part 105 has a protruding portion 1051. The surge absorber 12 includes a body 120 and a plurality of leads 121.

In this exemplary embodiment, the pyrocondensation belt 14 is connected to the casing 101, the protruding portion 1051, and the body 120 of the surge absorber 12. The moving part 105 is stuck in the casing 101 movably. The moving part 105 passes through the opening 1013, and the protruding portion 1051 is stuck out or embedded in the casing 101 according to the position of the moving part 105 respected to the opening 1013. The conductive pins 103 are stuck in the casing 101. In the other words, the conductive pins 103 are extended from the inside of the casing 101 to the outside of the casing 101. The switch unit 10 is disposed on the circuit board 16 via the conductive pins 103, and electrically connected between a power source (not shown) and the surge absorber 12. The leads 121 are stuck in the body 120 of surge absorber 12. The surge absorber 12 is disposed on the circuit board 16 via the leads 121, and electrically connected between the conductive pins 103 and a load (not shown).

Generally, the surge absorber 12 may have at least two leads 121. The power source has at least two terminals including a live terminal and a neutral terminal, or including a live terminal, a neutral terminal and a ground terminal. The two conductive pins 103 are connected to the live terminal and the neutral terminal respectively, or connected to the live terminal and the ground terminal respectively. Another two conductive pins 103 are connected to the two leads 121 of the surge absorber 12.

The pyrocondensation belt 14 is configured to shrink according to the heat conduction from the body 120 of the surge absorber 12. When the shrinkage degree of the pyrocondensation belt 14 is enough to change the position of the moving part 105 respected to the casing 101 and to convert the relationship of the two terminals of the power source (the live terminal and the neutral terminal, or the live terminal and the ground terminal) and the surge absorber 12 from connection to disconnection. As a result, the thermal protection module 1 is capable of cutting off the connection between the power source and the surge absorber 12 when the temperature of the surge absorber 12 is excessive or before the surge absorber 12 is failed, and protecting the load from the surges.

In practice, the casing 101 is located between the protruding portion 1051 and the surge absorber 12. The body 120 of the surge absorber 12 is wrapped with and insulating material such as silicon resin. The body 120 of the surge absorber 12 may be close to the casing 101 of the switch unit 10 or adhered to the outside lateral of the casing 101 via viscose. The moving part 105 may be made of material with good heat resistance and high tensile strength properties. The pyrocondensation belt 14 may be in a strip or a circle shape. In one implementation, the pyrocondensation belt 14 is in the strip shape, the pyrocondensation belt 14 may be connected to the body 120 of the surge absorber 12 and the protruding portion 1051 of the moving part 105 via viscose. If the pyrocondensation belt 14 is in the circle shape, the pyrocondensation belt 14 may be a pyrocondensation sleeve, and the pyrocondensation belt 14 encircles the casing 101 of the switch unit 10 and the body 120 of the surge absorber 12. In particular, the pyrocondensation belt 14 is passed through the guide rail 1011.

Figure 1B:
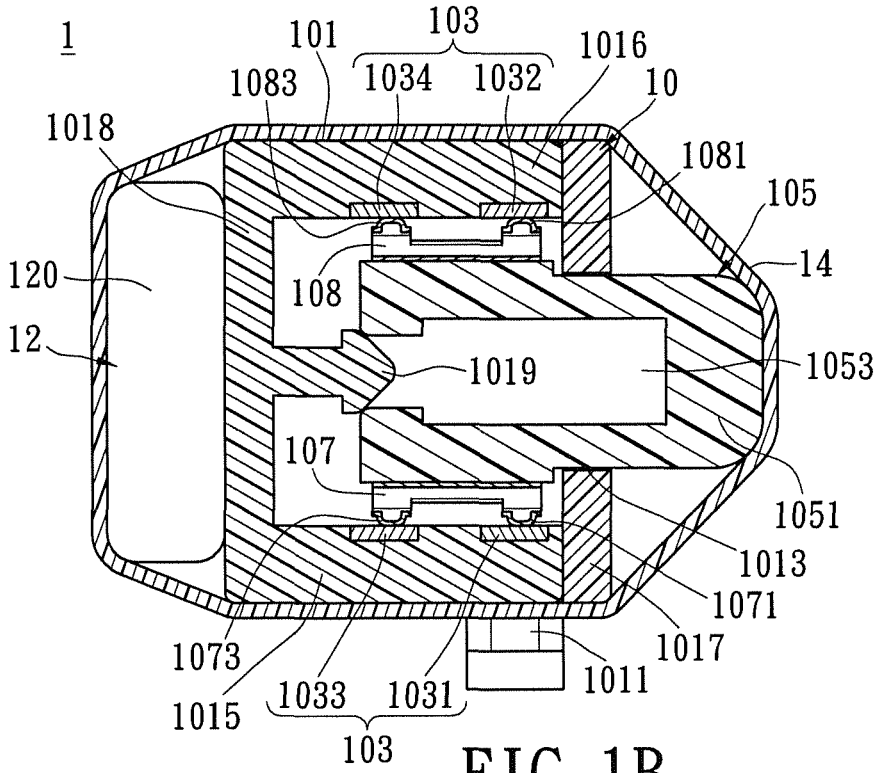
FIG. 1B is a cross-section diagram of the thermal protection module according to the exemplary embodiment of FIG. 1A.
Figure 1C:
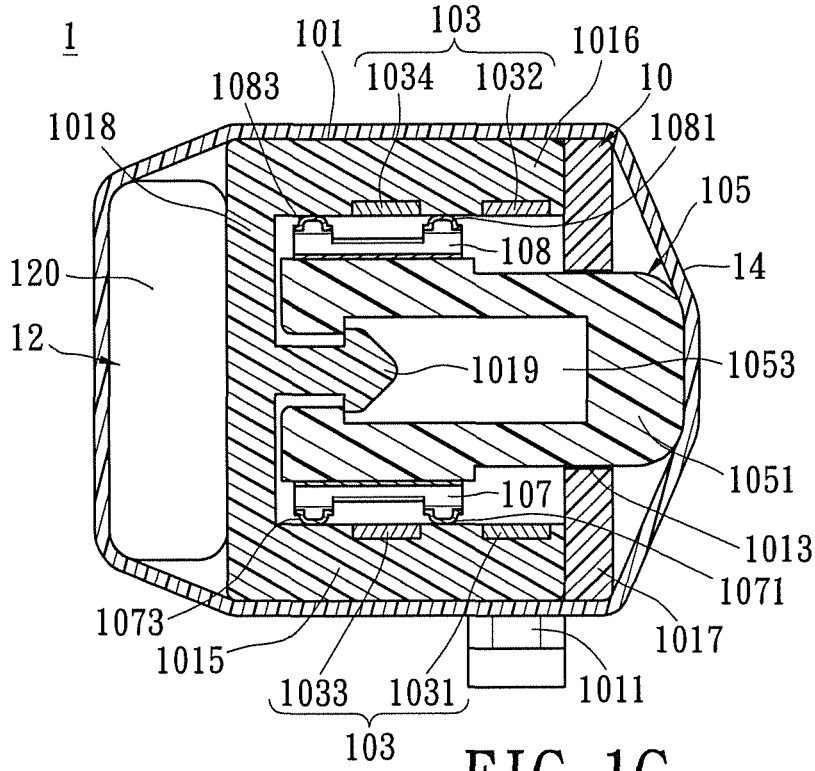
FIG. 1C is another cross-section diagram of the thermal protection module according to the exemplary embodiment of FIG. 1A.

Please refer to FIG. 1B and associated with FIG. 1C. FIG. 1B and FIG. 1C are illustrates cross-section diagrams of the thermal protection module according to the exemplary embodiment of FIG. 1A. The following descriptions further explain how the switch unit 10 can change relationship between the two terminals of the power source and the surge absorber 12. As shown in FIG. 1B, the casing 101 includes a first lateral plate 1015, a second lateral plate 1016, a third lateral plate 1017, and a fourth lateral plate 1018. The conductive pins 103 include a first conductive pin 1031, a second conductive pin 1032, a third conductive pin 1033, and a fourth conductive pin 1034. The switch unit 10 further includes a first conductive portion 107 and a second conductive portion 108.

In one implementation, the first lateral plate 1015 and the second lateral plate 1016 are opposite to each other, and the moving part 105 is disposed between the first lateral plate 1015 and the second lateral plate 1016 movably. The third lateral plate 1017 and the fourth lateral plate 1018 are opposite to each other, and the third plate 1017 and the fourth lateral plate 1018 are intersected the first lateral plate 1015 and the second lateral plate 1016 respectively. In addition, the moving part 105 has a slot 1053, and the casing 101 has a projection hook 1019, wherein the position on the moving part 105 where the slot 1053 disposed is corresponding to the position on the casing 101 where the projection hook 1019 disposed. In practice, the projection hook 1019 is disposed on the fourth lateral plate 1018. The opening 1013 is disposed on the third lateral plate 1017.

In one implementation, the first conductive pin 1031 and the third conductive pin 1033 are disposed on the first lateral plate 1015. The second conductive pin 1032 and the fourth conductive pin 1034 are disposed on the second lateral plate 1016. The first conductive portion 107 and the second conductive portion 108 are disposed on the opposite sides of the moving part 105 immovably. In particular, the position on the moving part 105 where the first conductive portion 107 is disposed is corresponding to the positions on the casing 101 where the first conductive pin 1031 and the third conductive pin 1033 disposed, and the position on the moving part 105 where the second conductive portion 108 is disposed is corresponding to the positions on the casing 101 where the second conductive pin 1032 and the fourth conductive pin 1034 are disposed. The management of the first conductive portion 107 and the second conductive portion 108 make the switch unit 10 to be a switch with the double-pole switch structure.

In practice, the first conductive pin 1031 is coupled to the live terminal, and the second conductive pin 1032 is coupled to the neural terminal or the ground terminal. The third conductive pin 1033 and the fourth conductive pin 1034 are coupled to the surge absorber 12.

When the temperature of the surge absorber 12 does not reach the critical temperature, the pyrocondensation belt 14 does not shrink or the degree of the shrinkage is not enough, the protruding portion 1051 is stuck out from the opening 1013, the first conductive portion 107 is in contact with the first conductive pin 1031 and the third conductive pin 1033, and the second conductive portion 108 is in contact with the second conductive pin 1032 and the fourth conductive pin 1034 as shown in FIG. 1B. As the result, the surge absorber 12 is electrically connected to the power source.

In one implementation, the first conductive portion 107 has two conductive contact points, such as a first contact point 1071 and a second contact point 1073. The first contact point 1071 and the second contact point 1073 would be in contact with the first conductive pin 1031 and the third conductive pin 1033 respectively when the temperature of the surge absorber 12 does not reach the critical temperature. The second conductive portion 108 has two conductive contact points, such as a third contact point 1081 and a fourth contact point 1083. The third contact point 1081 and the fourth contact point 1083 would be in contact with the second conductive pin 1032 and the fourth conductive pin 1034 respectively when the temperature of the surge absorber 12 does not reach the critical temperature.

When the temperature of the surge absorber 12 reaches the critical temperature, the shrinkage degree of the pyrocondensation belt 14 is enough to lead the moving part 105 to move forward to the inside of the casing 101 as shown in FIG. 1C. The moving direction of the moving part 105 is the same as the moving directions of the first conductive portion 107 and the second portion 208, and in other words, the first conductive portion 107 and the second portion 208 are moved along with the motion of the moving part 205. Therefore, the first conductive portion 107 would be disconnected from the first conductive pin 1031 and the third conductive pin 1033 according to the position of the moving part 105, and the second conductive portion 108 would be disconnected from the second conductive pin 1032 and the fourth conductive pin 1034 respectively. As the result, the surge absorber 12 is electrically disconnected from the power source. When the power source has the third terminal, the above two terminals thereof are still open without forming a loop since the two terminals are disconnected from the surge absorber 12.

It is worthy to notice that, because the pyrocondensation belt 14 is irreversible after shrinking, the moving part 105 may be moved on one-way. Moreover, the projection hook 1019 is accommodated in the slot 1053 after the moving part 105 has moved. The shape and the structure of the slot 1053 and the projection hook 1019 are not restricted in FIG. 1B and FIG. 1C. The slot 1053 is configured to provide a guide way for the projection hook 1019, and also latch the projection hook 1019 in the casing 101 after the moving part 105 has moved.

Figure 2A:
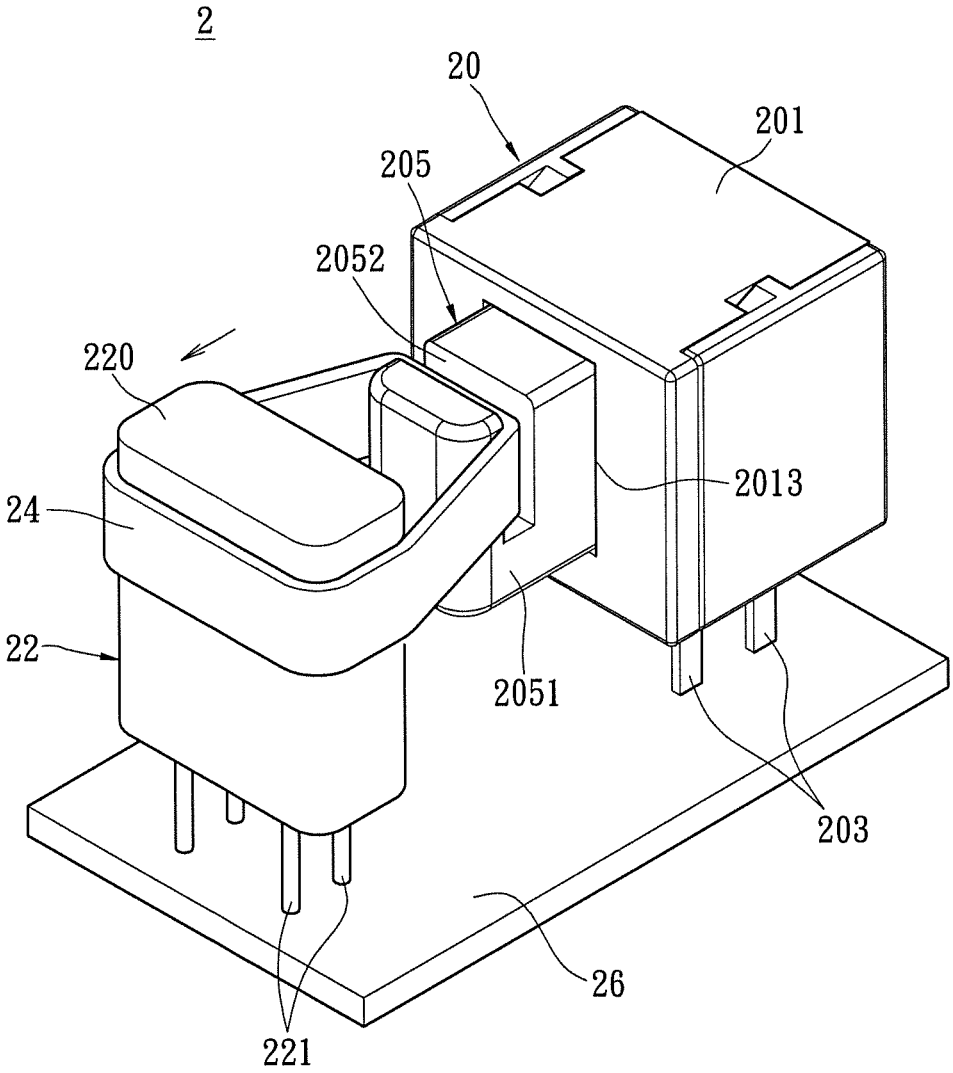
FIG. 2A is a schematic diagram of a thermal protection module according to another one embodiment of the present disclosure.

Refer to FIG. 2A. FIG. 2A illustrates a schematic diagram of a thermal protection module according to another one exemplary embodiment of the present disclosure. As shown in FIG. 2A, the thermal protection module 2 and the thermal protection module 1 in FIG. 1A are roughly the same. The thermal protection module 2 comprises a switch unit 20, a surge absorber 22, and a pyrocondensation belt 24. The switch unit 20 is disposed on the circuit board 26 via a plurality of conductive pins 203. The surge absorber 22 is disposed on the circuit board 26 via a plurality of leads 221.

It is different between FIG. 1A and FIG. 2A. The protruding portion 2051 of the moving part 205 is located between the surge absorber 22 and the casing 201, and the protruding is adjacent to the body 220 of the surge absorber 22. The pyrocondensation belt 24 is connected to the body 220 and the protruding portion 2051. When the temperature of the surge absorber 22 does not reach the critical temperature, the pyrocondensation belt 24 does not shrink or the degree of the shrinkage is not enough, the protruding portion 2051 is stuck out from the opening 2013, and there is a gap between the protruding portion 2051 and the body 220 of the surge absorber 22. When the temperature of the surge absorber 22 reaches the critical temperature, the shrinkage degree of the pyrocondensation belt 24 is enough to move the moving part 205, and the moving part 205 is moved forward to the outside of the casing 201.

In one implementation, the protruding portion 2051 has a guide rail 2052. The pyrocondensation belt 24 may be in a strip or a circle shape. If the pyrocondensation belt 24 is in the strip shape, the pyrocondensation belt 24 may be connected to the body 220 of the surge absorber 22 and the protruding portion 2051 of the moving part 205 via viscose. If the pyrocondensation belt 24 is in the circle shape, the pyrocondensation belt 24 may be a pyrocondensation sleeve, and the pyrocondensation belt 24 encircles the body 220 of the surge absorber 22, and is passed through the guide rail 2052.

Figure 2B:
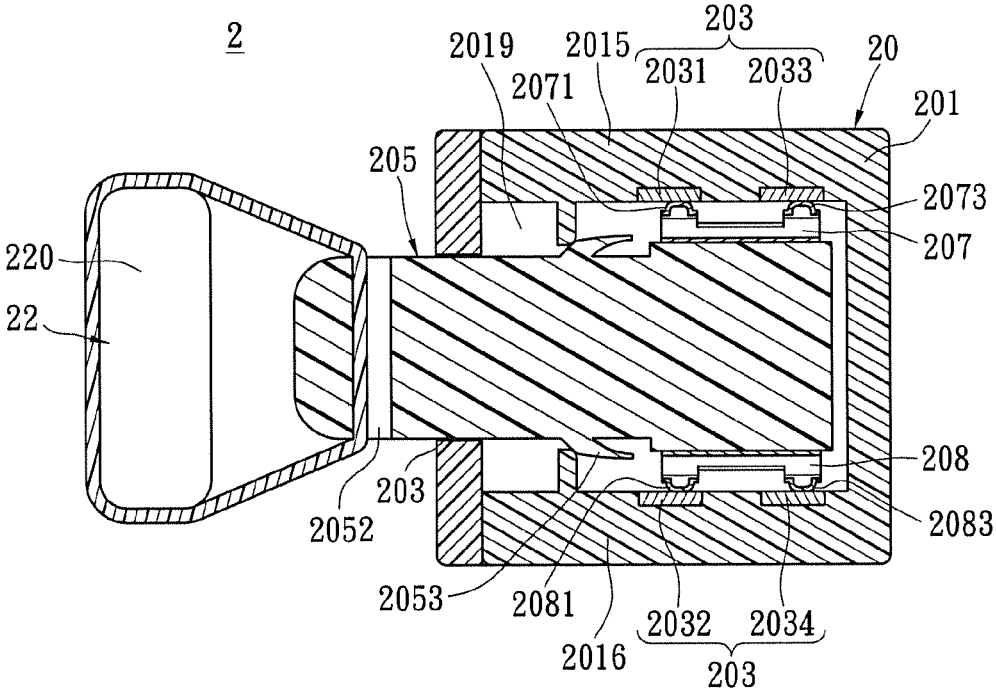
FIG. 2B is a cross-section diagram of the thermal protection module according to the exemplary embodiment of FIG. 2A.
Figure 2C:
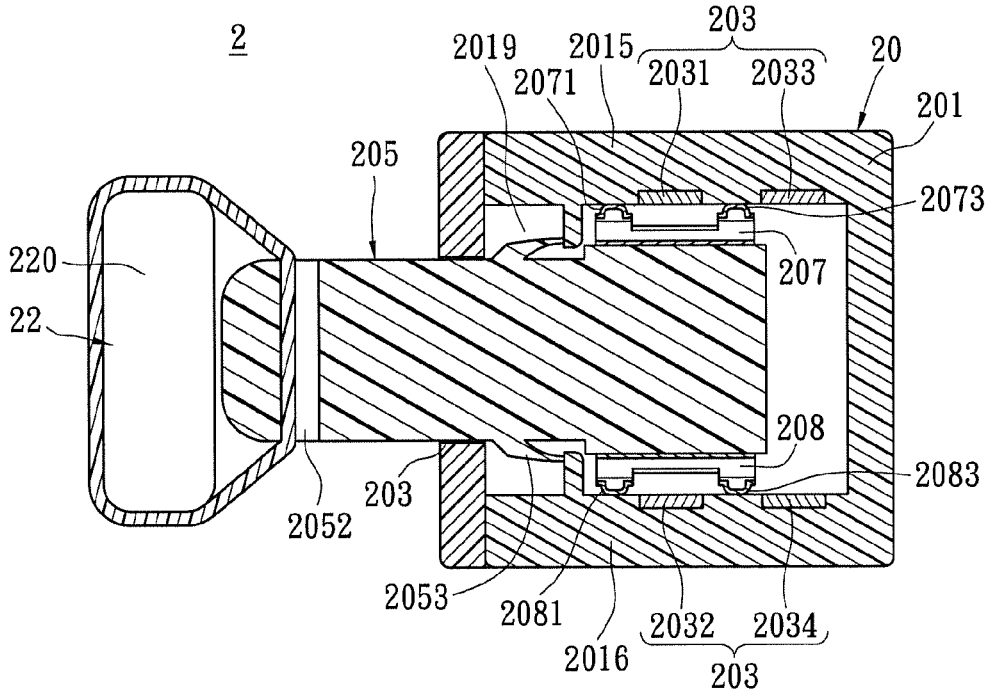
FIG. 2C is another cross-section diagram of the thermal protection module according to the exemplary embodiment of FIG. 2A.

Please refer to FIG. 2B and FIG. 2C. FIG. 2B and FIG. 2C illustrate cross-section diagrams of the thermal protection module according to the exemplary embodiment of FIG. 2A. As shown in FIG. 2B, the thermal protection module 2 and the thermal protection module 1 in FIG. 2A are roughly the same. The conductive pins 203 include a first conductive pin 2031, a second conductive pin 2032, a third conductive pin 2033, and a fourth conductive pin 2034. Each two conductive pins 203 are disposed on the first lateral plate 2015 and the second lateral plate 2016 respectively. The moving part 205 is disposed between the first lateral plate 2015 and the second lateral plate 2016 movably. The difference between FIG. 2B and FIG. 1B is that the moving part 205 has a plurality of projection hooks 2053, and the casing 201 has a plurality of slots 2019 disposed on the first lateral plate 2015 and the second lateral plate 2016. The positions on the moving part 205 where the projection hooks 2053 are disposed are adjacent to the positions on the casing 201 where the slots 2019 are disposed.

When the temperature of the surge absorber 22 does not reach the critical temperature, the pyrocondensation belt 24 does not shrink or the degree of the shrinkage is not enough, the protruding portion 2051 is stuck out from the opening 2013, the first conductive portion 207 is in contact with the first conductive pin 2031 and the third conductive pin 2033, and the second conductive portion 208 is in contact with the second conductive pin 2032 and the fourth conductive pin 2034 as shown in FIG. 2B. As the result, the surge absorber 22 is electrically connected to the power source.

When the temperature of the surge absorber 22 reaches the critical temperature, the shrinkage degree of the pyrocondensation belt 24 is enough to lead the moving part 205 to move forward to the outside of the casing 201 as shown in FIG. 2C. The moving direction of the moving part 205 is the same as the moving directions of the first conductive portion 207 and the second portion 208, and in other words, the first conductive portion 207 and the second portion 208 are moved along with the motion of the moving part 205. Therefore, the first conductive portion 207 would be disconnected from the first conductive pin 2031 and the third conductive pin 2033 according to the position of the moving part 205, and the second conductive portion 208 would be disconnected from the second conductive pin 2032 and the fourth conductive pin 2034 respectively. As the result, the surge absorber 22 is electrically disconnected from the power source. When the power source has the third terminal, the above two terminals thereof are still open without forming a loop since the two terminals are disconnected from the surge absorber 22.

It is worthy to notice that, because the pyrocondensation belt 24 is irreversible after shrinking, the moving part 205 may be moved on one-way. Moreover, the projection hooks 2053 are accommodated in the slots 2019 after the moving part 205 has moved. The shape and the structure of the slots 2019 and the projection hooks 2053 are not restricted in FIG. 2B and FIG. 2C. The slots 2019 are configure to provide a guide way for the projection hooks 2053, and also latch the projection hooks 2053 in the casing 201 after the moving part 205 has moved.

Figure 2D:
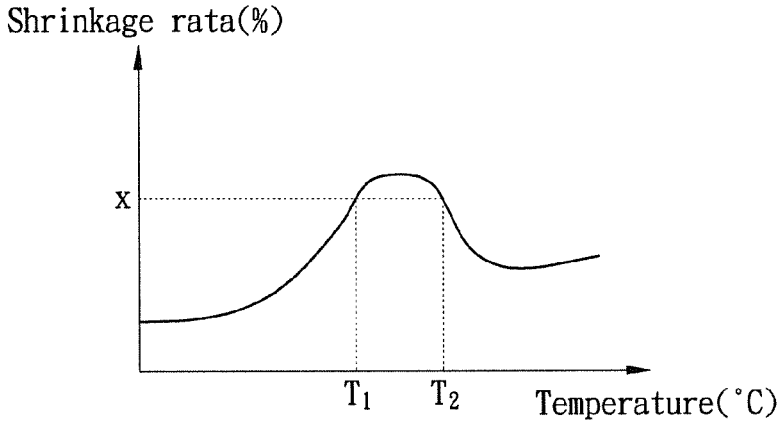
FIG. 2D is a characteristic curves of a pyrocondensation belt of the thermal protection module according to an exemplary embodiment of the present disclosure.

Please refer to FIG. 2D. FIG. 2D illustrates a characteristic curves of a pyrocondensation belt of the thermal protection module according to an exemplary embodiment of the present disclosure. The x-axis denotes the temperature T(° C.), and the y-axis denotes the shrinkage rate S(%).

Figure 3:
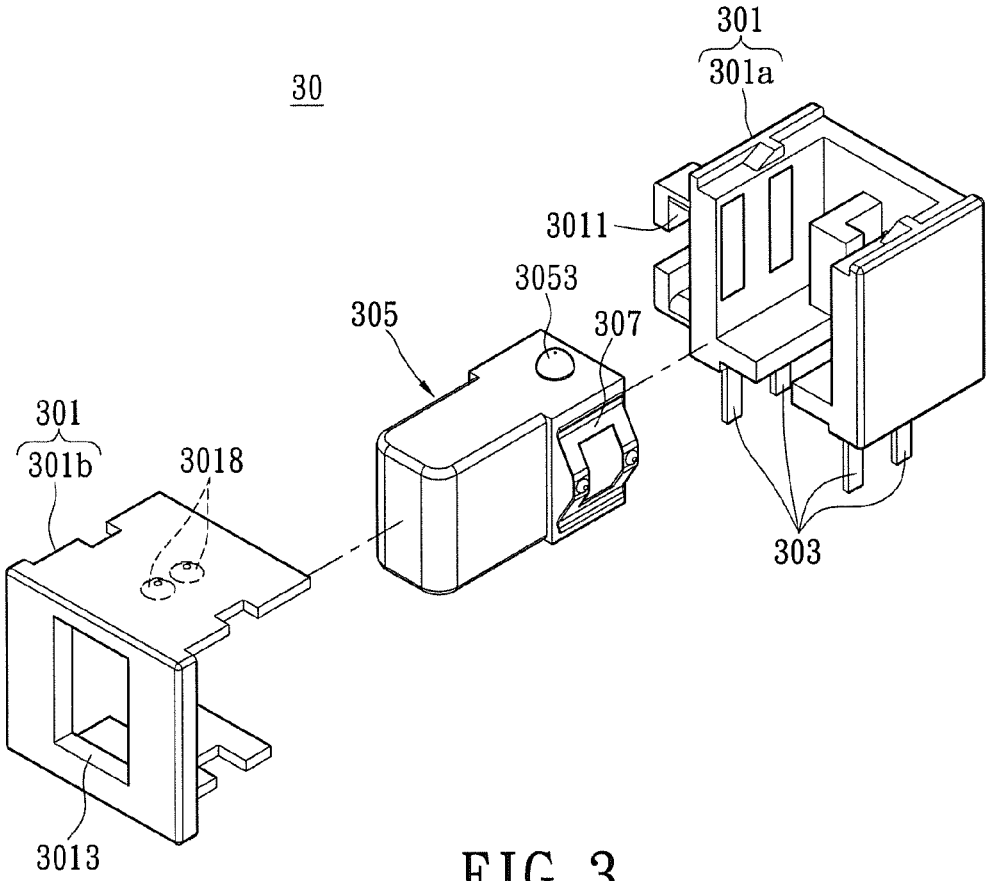
FIG. 3 is an explosive diagram of a thermal protection module according to an exemplary embodiment of the present disclosure.

Please refer to FIG. 3. FIG. 3 illustrates an explosive diagram of a thermal protection module according to an exemplary embodiment of the present disclosure. In particular, FIG. 3 illustrates a switch unit 30, which may be applied for the thermal protection module 1 or the thermal protection module 2.

The switch unit 30 comprises a casing 301, a plurality of conductive pins 303, a moving part 305, a first conductive portion 307, and a second conductive portion (not shown). The casing 301 includes a frame 301*a* and a cover 301*b*. The frame 301*a* has a guide rail 3011. The cover 301*b* has an opening 3013 and a plurality of stopping holes 3018. The moving part 305 has a salient point 3053.

Each two conductive pins 303 are disposed on the opposite inner sides of the frame 301*a*. The first conductive portion 307 and the second conductive portion are disposed on two sides of the moving part 305. The positions on the frame 301*a* where the conductive pins 303 are disposed are corresponding to the positions on the moving part 305 where the first conductive portion 307 and the second conductive portion are disposed respectively. The position on the moving part 305 where the salient point 3053 is disposed is corresponding to the positions on the cover 301*b* where the stopping holes 3018 are disposed.

In one implementation, the first conductive portion 307 and the second conductive portion may be the conductive sheets with physical resilience. The first conductive portion 307 and the second conductive portion are in contact with the conductive pins 303 respectively via a plurality of contact points (not shown) disposed on the first conductive portion 307 and the second conductive portion. The relationship between the contact points and the conductive pins 303 can be known by the above exemplary embodiments, therefore omitting the redundant descriptions.

The pyrocondensation belt (not shown) may encircle the casing 301 and surge absorber (not shown) through the guide rail 3011 disposed on the casing 301. The pyrocondensation belt may also be connected to the surge absorber and the moving part 305. In another one implementation, the pyrocondensation belt may pass through the guide rail (not shown) disposed on the moving part 305 without encircling the casing 301.

When the shrinkage degree of the pyrocondensation belt is enough to move the moving part 305 due to the temperature of the surge absorber, the moving part 305 may be moved in the casing 301 for changing the relationship between the first conductive portion 307 and the conductive pins 303 and the relationship between the second conductive portion and the conductive pins 303 from connection to disconnection. The shape and size of the stopping holes 3018 is consistent with the shape and size of the salient point 3053. The salient point 3053 is accommodated in different stopping holes 3018 according to the position of the moving part 305 for stabilizing the position of the moving part 305 before or after moving.

Figure 4A:
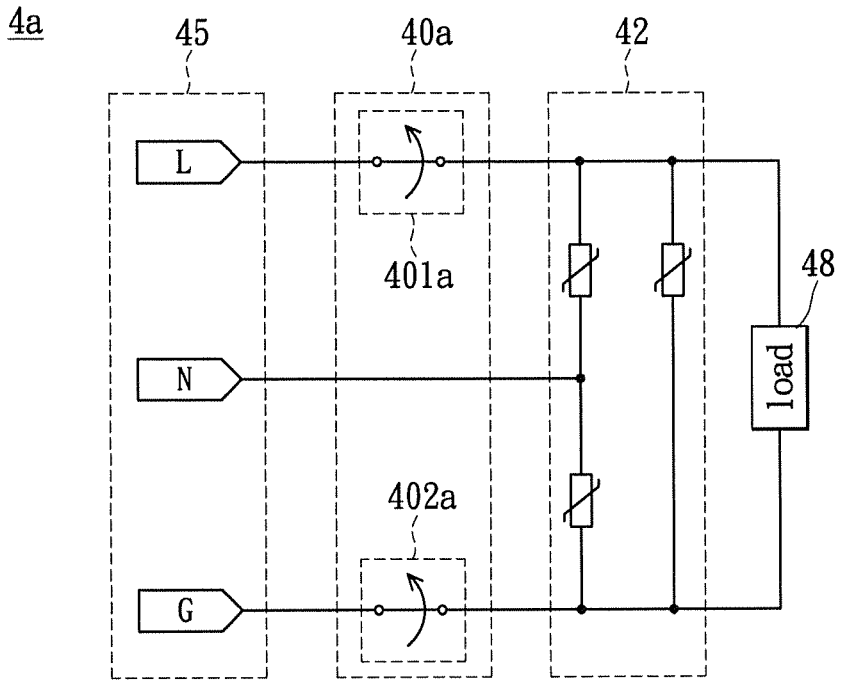
FIG. 4A is a circuit diagram of a thermal protection module according to an exemplary embodiment of the present disclosure.

Please refer to FIG. 4A. FIG. 4A illustrates a circuit diagram of a thermal protection module according to an exemplary embodiment of the present disclosure. The thermal protection module 4*a* comprises a switch unit 40*a* and a surge absorber 42. The switch unit 40*a* is electrically connected to the power source 45. The surge absorber 42 is electrically connected to the switch unit 40*a* and the load 48.

In one complementation, the surge absorber 42 has at least one surge absorber device, such as three surge absorber devices in a parallel connection or series connection one another. The switch unit 40*a* includes a first switch unit 401*a* and a second switch unit 402*a* as a switch unit with a double-pole switch structure. The first switch unit 401*a* and the second switch unit 401*b* are electrically connected to the live terminal L and the ground terminal G respectively. When the voltage spikes passing through the live terminal L or the ground terminal G are higher than the rated voltage of one of the surge absorber devices, the first switch unit 401*a* and the second switch unit 402*a* are operated on the off state for cutting off the connection between the surge absorber 42 and the power source 45 for protection the load 48 from the voltage spikes.

Figure 4B:
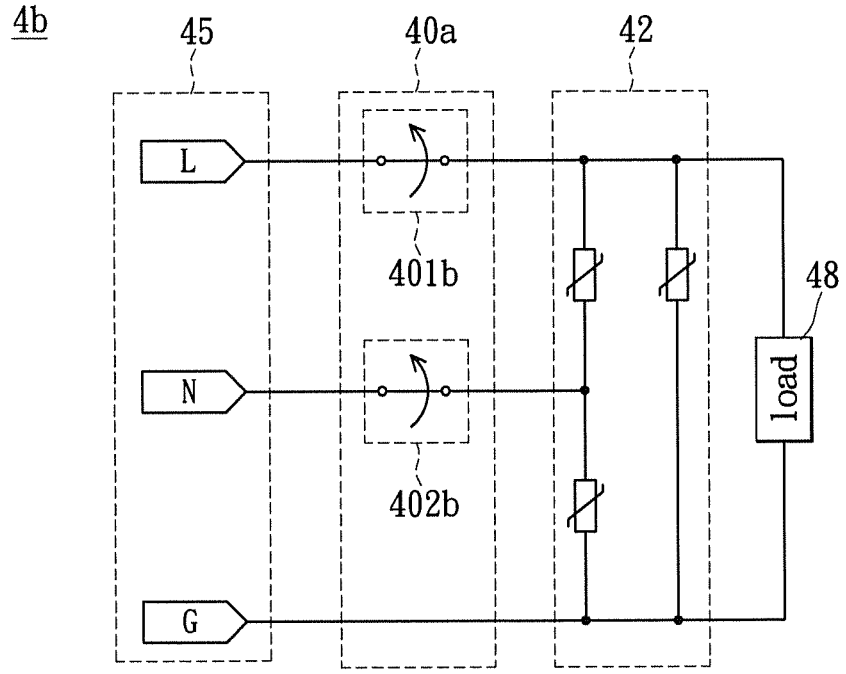
FIG. 4B is a circuit diagram of a thermal protection module according to another one exemplary embodiment of the present disclosure.

Please refer to FIG. 4B. FIG. 4B illustrates a circuit diagram of a thermal protection module according to another exemplary embodiment of the present disclosure. The thermal protection module 4*b* and the thermal protection module 4*a* are roughly the same. The difference between FIG. 4B and FIG. 4A is that the first switch unit 401*b* and the second switch unit 402*b* of the switch unit 40*b* are electrically connected to the live terminal L and the neutral terminal N respectively. When the voltage spikes passing through the live terminal L or the neutral terminal N are higher than the rated voltage of one of the surge absorber devices, the first switch unit 401*b* and the second switch unit 402*b* are operated on the off state for cutting off the connection between the surge absorber 42 and the power source 45 for protection the load 48 from the voltage spikes.

To sum up, the exemplary embodiments according to the present disclosure relate to the thermal protection module capable of being power off via the properties of the pyrocondensation belt associated with the structure of the switch unit. In particular, the switch unit is irreversible after the pyrocondensation belt has shrunk so as to prevent the surge absorber from being on fire.

Some modifications of these examples, as well as other possibilities will, on reading or having read this description, or having comprehended these examples, will occur to those skilled in the art. Such modifications and variations are comprehended within this present disclosure as described here and claimed below. The description above illustrates only a relative few specific exemplary embodiments and examples of the present disclosure. The present disclosure, indeed, does include various modifications and variations made to the structures and operations described herein, which still fall within the scope of the present disclosure as defined in the following claims.

What is claimed is:

1. A thermal protection module, comprising:

a surge absorber;

a switch unit, comprising a casing, a first conductive pin, a moving part, and a first conductive portion, wherein the moving part is mounted in the casing movably, the first conductive pin is mounted in the casing, the first conductive portion is disposed on the moving part, and the first conductive portion is in contact with or separated from the first conductive pin; and a pyrocondensation belt, connected to the surge absorber and the moving part; wherein the casing has an opening, and the moving part has a protruding portion, the moving part passes through the opening, and the protruding portion is protruding out from the opening.

2. The thermal protection module as claimed in claim 1, wherein the pyrocondensation belt is configured to shrink according to a heat conduction from the surge absorber, so that the first conductive portion is in contact with or separated from the first conductive pin.

3. The thermal protection module as claimed in claim 2, wherein when the pyrocondensation belt is shrunk to move the moving part, a moving direction of the moving part is the same as a moving direction of the first conductive portion.

4. The thermal protection module as claimed in claim 1, wherein the switch unit further comprises a second conductive pin, a third conductive pin, a fourth conductive pin, and a second conductive portion; the second conductive pin, the third conductive pin and the fourth conductive pin are mounted in the casing and coupled to the surge absorber; the second conductive portion is disposed on the moving part; the third conductive pin is in contact with or separated from the first conductive portion; and the second conductive portion is in contact with or separated from the second conductive pin and the fourth conductive pin.

5. The thermal protection module as claimed in claim 4, wherein the first conductive portion and the second conductive portion are a plurality of conductive sheets with physical resilience.

6. The thermal protection module as claimed in claim 1, wherein the pyrocondensation belt is a pyrocondensation sleeve.

7. The thermal protection module as claimed in claim 1, wherein the casing is located between the protruding portion and the surge absorber, and the pyrocondensation belt encircles the casing, the protruding portion, and the surge absorber.

8. The thermal protection module as claimed in claim 7, wherein the switch unit further comprises a guide rail disposed on the outside of the casing, and the pyrocondensation belt passes through the guide rail.

9. The thermal protection module as claimed in claim 1, wherein the protruding portion is located between the surge absorber and the casing.

10. The thermal protection module as claimed in claim 9, wherein the protruding portion has a guide rail, and the pyrocondensation belt encircles the surge absorber and passes through the guide rail.

11. The thermal protection module as claimed in claim 1, wherein the moving part has a slot, and the casing has a projection hook disposed therein, the projection hook is accommodated in the slot when the first conductive portion is separated from the first conductive pin.

12. The thermal protection module as claimed in claim 1, wherein the moving part has a projection hook, and the casing has a slot disposed therein, the projection hook is accommodated in the slot when the first conductive portion is separated from the first conductive pin.

13. The thermal protection module as claimed in claim 1, wherein the moving part has a salient point, and the casing has a first stopping hole and a second stopping hole both located in the casing; when the first conductive portion is in contact with the first conductive pin, the salient point is disposed in the first stopping hole; when the first conductive portion is separated from the first conductive pin, the salient point is disposed in the second stopping hole.

* * * * *